US006186869B1

(12) United States Patent
MacFarlane et al.

(10) Patent No.: US 6,186,869 B1
(45) Date of Patent: Feb. 13, 2001

(54) CLEANING USING WELDING LANCES AND BLASTING MEDIA

(75) Inventors: William MacFarlane, Derbyshire (GB); Steve Cherico, North Olmstead; Dale R. Miller, II, Middleburg Heights, both of OH (US)

(73) Assignee: Cetek Limited, Berea, OH (US)

( * ) Notice: Under 35 U.S.C. 154(b), the term of this patent shall be extended for 0 days.

(21) Appl. No.: 09/249,111

(22) Filed: Feb. 12, 1999

(51) Int. Cl.[7] ..... B24B 1/00
(52) U.S. Cl. ..... 451/39
(58) Field of Search ..... 451/38, 39, 40, 451/53, 102

(56) References Cited

U.S. PATENT DOCUMENTS

| | | | | |
|---|---|---|---|---|
| 4,489,022 | | 12/1984 | Robyn et al. . | |
| 4,542,888 | | 9/1985 | Robyn . | |
| 4,560,591 | | 12/1985 | Plumat et al. . | |
| 4,792,468 | | 12/1988 | Robyn et al. . | |
| 4,818,574 | | 4/1989 | Motett . | |
| 4,911,955 | | 3/1990 | Motett . | |
| 4,920,084 | | 4/1990 | Robyn et al. . | |
| 4,967,686 | | 11/1990 | Motett et al. . | |
| 4,988,647 | | 1/1991 | Mottet et al. . | |
| 5,002,805 | | 3/1991 | Robyn . | |
| 5,002,910 | | 3/1991 | Robyn . | |
| 5,011,443 | * | 4/1991 | Park | 451/39 |
| 5,061,526 | | 10/1991 | Robyn et al. . | |
| 5,100,594 | | 3/1992 | Zvosec et al. . | |
| 5,378,493 | | 1/1995 | Zivkovic . | |
| 5,512,006 | * | 4/1996 | Wood et al. | 451/39 |
| 5,795,214 | * | 8/1998 | Leon | 451/102 |

FOREIGN PATENT DOCUMENTS

| | | |
|---|---|---|
| 1330894 | 9/1973 | (GB) . |
| 2110200 | 6/1983 | (GB) . |
| 01177967 | 7/1989 | (JP) . |

OTHER PUBLICATIONS

Report No. CETHA–TE–CR–89004 "Demonstration Testing of Plastic Media Blasting (PMB) at Letterkenny Army Depot", Jan. 1989, Arthur D. Little, Inc.

Society of Manufacturing Engineers Technical Paper FC70–280 "The Organic and Plastic Media in Massing Finishing Today" by A. A. Polucha, admitted prior art.

Hammons Products Company brochure "Some Facts Concerning Black Walnut Shell", admitted prior art.

Agrashell, Inc. brochure regarding "Shelblast" Product, admitted prior art.

(List continued on next page.)

*Primary Examiner*—Rodney A. Butler
(74) *Attorney, Agent, or Firm*—Nixon & Vanderhye P.C.

(57) ABSTRACT

It is possible to clean high temperature (over 400, e. g. over 1000, degrees F) surfaces in a time and cost efficient manner by using a liquid-cooled ceramic welding lance to direct (at super-atmospheric pressure) a blasting media at the surfaces to be cleaned. The blasting media is preferably combustible at the temperature of the environment surrounding the surfaces, and may include one or more organic agricultural abrasive materials (preferably black walnut shells) as the sole or primary constituent. Blasting may be practiced by directing the media at the surfaces to be cleaned at a pressure of between about 40–100 psi, for example continuously for as long as is necessary (e. g. more than 30 minutes), without any need to remove the lance from the environment. The method is desirably practiced to clean, while in operation or in situ, metal surfaces having scale buildup which adversely affects the ability of the metal surfaces to transfer heat, reheat tubes, process tubes, furnace surfaces, or the like.

20 Claims, 1 Drawing Sheet

OTHER PUBLICATIONS

NASA Briefs, Fall 1983, vol. 8, No. 1, NFS–2701 "Walnut Huils clean Aluminun".
"Overview of Paint Removal Methods", Dr. Terry Foster, AGAR SMP Lecture Series, Apr., 1995.
"Current Uses in Transfer Plastic Blast Media", Society of Plastics Engineers, 1997.
"Thermoset Retec Golubski", Mar. 1997.
"Statistical Evaluation of the Effects of Shot–Peening on Stress Corrosion of Alloy 600 and PWR Steam Generators", Electricite de France, ISSN 1611–0611, Pitner et al, 1994.
Products Finishing Magazine, Apr. 1984, "Between Soft and Hard: Plastic Blast Media Fills Need".
Fosbel, Inc. brochure "Refractory Renewal Without Shutdown", 1997.

* cited by examiner

CLEANING USING WELDING LANCES AND BLASTING MEDIA

BACKGROUND AND SUMMARY OF THE INVENTION

There are many situations in which it is desirable to clean surfaces of scale, corrosion, or contaminant buildup, in high temperature environments. For example, in the petrochemical industry, "white metal cleaning" (that is cleaning the metal so that it is free of scale and other buildup) is often desirable, as is cleaning of reheat tubes, or any metal surfaces where scale buildup may impede the thermal transferability of the metal surface. Also, in a number of different conventional furnaces, cleaning of the furnace walls, ceiling, and possibly even floor, is occasionally desirable.

In the past it has been difficult to properly effect cleaning in high temperature environments in a time and cost efficient manner. Typical commercial operations can only direct a blasting media against the high temperature surfaces that require cleaning at operating temperature or in situ for only a few minutes. Otherwise the equipment utilized to effect cleaning is compromised. Therefore, it is necessary to blast for a few minutes, remove the equipment, and subsequently reintroduce it, until ultimately the cleaning operation is substantially complete. Using conventional commercial techniques, it is also difficult to effect cleaning of all of the surfaces that need cleaning without constantly moving equipment from place to place since typically equipment is limited to cleaning 5 or 15 feet from the equipment location. Also, typically inorganic blasting media, such as sand, glass beads, or the like, are utilized in some environments, which causes a buildup on the floor or lower surface surrounding the areas being cleaned, necessitating the removal of the blasting media.

According to the present invention a method is provided which overcomes the problems of the prior art commercial installations discussed above. According to the present invention, it is possible to clean high temperature surfaces even while the equipment is in operation, or at least in situ and still at high temperature, for essentially continuously as long as necessary in order to properly effect cleaning. Also cleaning may be effected at locations within a furnace or other installation to be cleaned up to 40 feet (or even more) without requiring removal of the equipment, and in some circumstances areas can be reached that cannot practically be reached by any commercial technique (although there may be a need to employ several lances, of different and irregular shapes, in a particular furnace to practice the invention).

Also, the invention can be practiced with a blasting media that combusts at the high temperature in the high temperature environment where cleaning is being effected, such as by using primarily or substantially exclusively organic blasting media, such as walnut shells. Walnut shells, and other agricultural particles such as peach or apricot stone particles, corn cob particles, and the like, are well known as media for cleaning aluminum or other metal surfaces of paint or corrosion, and for mass deburring and finishing of small components utilizing tumbling barrels or vibratory cleaners. However, use as a blasting media in high temperature environments over extended time periods has not heretofore been practical. However, such media may be used practically in a highly advantageous manner according to the method of the present invention.

It is possible to practice the method according to the present invention by utilizing a standard piece of equipment well known in another art. In the art of ceramic welding (such as discussed generally in U.S. Pat. Nos. 5,100,594 and 5,378,493, the disclosures of which are hereby incorporated by reference herein), equipment known as a liquid-cooled welding lance is typically used to apply a particulate material that is used to patch up furnace surfaces of refractory material. While these welding lances may have a number of configurations, typically they include single or double cooled liquid (typically water) circulating tubes surrounding a welding particulate material center tube. The welding lances are typically made out of steel or like corrosion and temperature resistant material, and steel spacers are typically provided spacing the various tubular elements from each other. Utilizing these welding lances, high temperature repairs of refractory surfaces of furnaces are practiced while the furnaces are at operating temperature, and substantially continuously without the need to reposition the lances from place to place and attempted access to the furnace to be repaired at different locations. These welding lances, such as used by Fosbel, Inc. of Berea, Ohio, and other companies of the Fosbel Group, can access locations easily up to 40 feet (and perhaps more) within a furnace to be repaired.

According to the present invention, the liquid-cooled welding lances that are typically used for ceramic welding are used for effecting cleaning of surfaces that have scale, corrosion, or other contaminant buildups thereon. By practicing the invention it is possible to effectively clean the surfaces in a time and cost efficient manner, without destroying the surfaces, and with a minimum of practical difficulty. Conventional liquid cooled welding lances are easily modified to practice the invention since it is merely a matter of utilizing a different media, and perhaps different pressures and details of movements of the lances, for introduction into an area to be treated. Also the owner of the equipment being treated will get increased production because the furnace need not be shut down to practice the invention, and there is no need to lower the temperature of the furnace to ensure no damage to equipment, as is typically necessary with other technologies.

According to one aspect of the invention, a method of cleaning surfaces at high temperature using a liquid-cooled lance (a conventional lance for ceramic welding) is provided comprising: (a) While the surfaces are at a temperature of 400 degrees F or more, positioning the liquid-cooled lance in operative association with the surfaces. (b) Introducing particulate blasting media through the lance under superatmospheric pressure so that the blasting media impacts the surfaces and cleans them while the surfaces are at a temperature of 400 degrees F or more. And (c) continuing (b), without the necessity of removing the lance to a location remote from operative positioning with respect to the surfaces, until the surfaces are substantially cleaned. Of course depending upon the surfaces to be cleaned (a)–(c) may be practiced while the surfaces are at a temperature of more than 1000° F. (or more than every other temperature between 400 and 1000° F.); in fact there is almost no limit, from the practical standpoint, of the temperature of the surfaces to be cleaned since the liquid cooled lances can be designed with extra cooling capacity, double sleeves, or the like, so as to be useful in almost any normal industrial environment. While the invention of the method is practical in almost any industrial situation where high temperature cleaning is desirable, such as in the petrochemical art, typically (a)–(c) are practiced to clean, while in operation or in situ, metal surfaces having scale buildup which adversely affects the ability of the metal surfaces to transfer heat, reheat tubes (i.e. process tubes), or furnace surfaces; or to practice scale/oxide removal of any sort.

In the preferred embodiment of the invention, (b) is practiced using a blasting media that combusts at a temperature of the environment surrounding the surfaces to be cleaned, so that after impacting the surfaces the blasting media will not build up significantly in the environment. For example, (b) may be practiced using one or more organic agricultural abrasive materials (such as pecan, acorn, coconut, or almond shells, peach, apricot, cherry, or plum pits, or even some organic seeds such as olive and prune seeds) as the primary or substantially sole constituent of the blasting media. However, the preferred blasting media is primarily or substantially solely walnut shells, most desirably black walnut shells. Black walnut shells typically have an average hardness of about 2.5–3 moh and a modulus of elasticity of 175,000 psi. Step (b) is preferably practiced using blasting media having an average hardness of between about 2–4 moh, a modulus of elasticity greater than 75,000 psi, and an average particle size of between about 10–100 mesh, e.g. 30–60 mesh, but dependent upon the particular surfaces to be cleaned.

Other materials, such as plastic blast media ("PMB"), may be utilized as the blasting media, or part of the blasting media mixed with walnut shells or other organic material. There are typically three types of PMB, polyester (3.0 moh), urea formaldehyde (3.5 moh), and melamine formaldehyde (4.0 moh). Often blasting media with a hardness much higher than 4 moh, or some types of plastic, may have adverse environmental consequences (as evaluated by the EPA, OHSA, DOT, or like agencies), or contaminate the area being cleaned, and should usually be avoided. Therefore, if universal applicability of the blasting media is a desired feature, then a hardness of about 4 moh or less, while still capable of performing effective cleaning, without buildup or adverse environmental consequences, is desirable.

In the above described method (b) may be practiced by directing the blasting media at the surfaces at a pressure of about 40–100 psi. While the pressure will depend upon the particular surfaces involved and the blasting media utilized, for black walnut shells, the desired value is between about 40–100 psi, e.g. about 80 psi. The method of the invention allows (c) to be practiced substantially continuously virtually indefinitely, but certainly for more than thirty minutes (e.g. 45–180 minutes) without any need to remove the lance from the high temperature environment since the lance readily resists the high temperature of the environment. Also, because the lance may easily be made to operating lengths of 40 feet, or even more, in almost all practical situations the equipment may be positioned only once to effect complete cleaning of the desired surfaces of any particular installation.

The other equipment utilized in the practice of the invention, such as the cooling water circulating equipment, and the media introduction equipment, are also the same conventional equipment as used for ceramic welding, such as by Fosbel, Inc. The same types of pumps for circulating the cooling liquid and for pressurizing the media introduced for ceramic welding applications are suitable for the cleaning method according to the invention.

According to another aspect of the present invention a method of cleaning surfaces at high temperature using a liquid cooled lance is provided comprising: (a) While the surfaces are at a temperature of 400 degrees F or more, positioning the liquid-cooled lance in operative association with the surfaces. And (b) introducing particulate blasting media through the lance under super-atmospheric pressure so that the blasting media impacts the surfaces and cleans the surfaces while the surfaces are at a temperature of 400 degrees F or more; and wherein (b) is practiced using a blasting media that combusts at the temperature of the environment surrounding the surfaces to be cleaned, so that after impacting the surfaces the blasting media will not build up significantly in the environment.

In this aspect of the method, (b) is preferably practiced using one or more organic agricultural abrasive materials as the primary constituent of the blasting media, and by directing the media at the surfaces at a pressure of between 40–100 psi, e.g. by using black walnut shells as substantially the sole constituent of the blasting media. In any event preferably (b) may be practiced by using a blasting media having an average hardness of between about 2.5–4 moh, and having an average particle size of between about 10–100 mesh. Also, typically (a) and (b) are practiced substantially continuously for at least thirty minutes.

According to yet another aspect of the present invention there is provided a method of cleaning a surface at a temperature of 1000° F. or more by directing substantially continuously for at least 15 minutes a substantially combustible, particulate blasting media comprising primarily, or substantially solely, black walnut shells, under super-atmospheric pressure against the surface to be cleaned so that the blasting media impacts the surface and effects abrasive cleaning thereof, and then combusts.

It is the primary object of the present invention to provide a time and cost efficient method for the cleaning of high temperature surfaces, such as in the petrochemical industry, furnaces, and the like. This and other objects of the invention will become clear from an inspection of the detailed description of the invention, and from the appended claims.

DETAILED DESCRIPTION OF THE DRAWINGS

Figure 1:
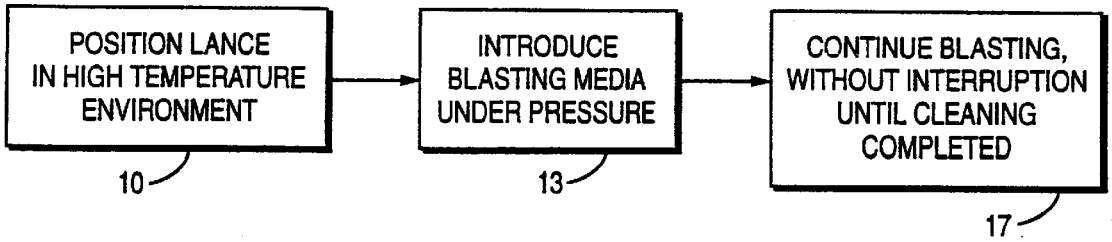
FIG. 1 is a block diagram schematically illustrating exemplary method steps that may be practice according to the invention.

FIG. 1 schematically illustrates one exemplary method according to the present invention for cleaning surfaces in high temperature environments while the surfaces are at high temperature. That is, the method illustrated schematically in FIG. 1 may be practiced while the equipment containing surfaces (such as a furnace, process tubes, a heat exchanger, or the like) is actually in operation, or at least at high temperature, there being no necessity to wait for the surfaces to cool, or to remove the surfaces, in order to effect cleaning.

Figure 2:
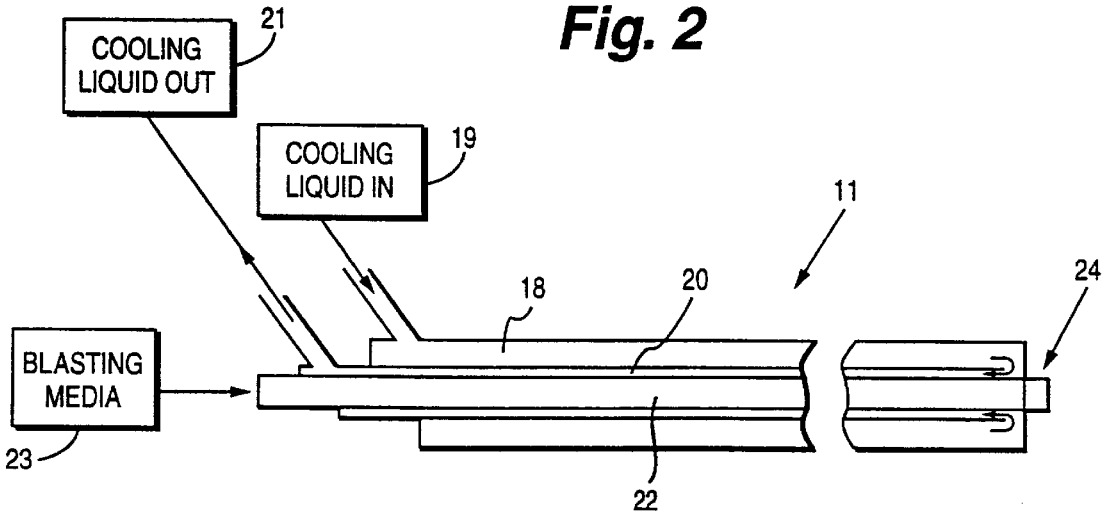
FIG. 2 is a schematic longitudinal sectional view of a conventional ceramic welding lance that is utilized in the practice of the cleaning method according to the present invention.
Figure 3:
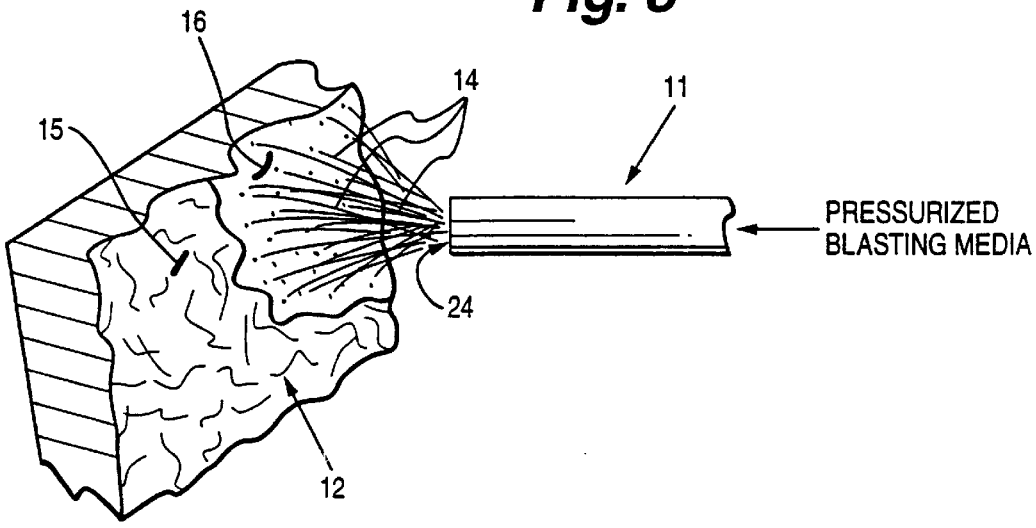
FIG. 3 is a schematic perspective view illustrating the cleaning of a high temperature surface utilizing the lance of FIG. 2 in the practice of the present invention.

The first step, indicated generally at 10 in FIG. 1, is to position a liquid-cooled lance—such as the lance illustrated schematically at 11 in FIG. 2—in operative association with the surfaces to be cleaned, such as the surface indicated schematically at 12 in FIG. 3. Then, as illustrated schematically at 13 in FIG. 1, the blasting media 10 is introduced under pressure, through the lance 11, so that it impacts the surfaces 12 and cleans them while the surfaces 12 are at high temperature (that is, 400° F. or more, typically 1000° F. or more, with almost no practical limit). FIG. 3 schematically illustrates a particular blasting material at 14, and shows, schematically, the corrosion or other contaminant 15 buildup being removed to provide an area 16 that has been rendered substantially free of the contaminant 15 (i.e. surface 16 is substantially clean).

As illustrated schematically at 17 in FIG. 1 blasting using the lance 11 is continued until the desired level of cleaning has been achieved. As indicated at 17 blasting may continue substantially without interruption, without shutting the unit being cleaned down, until the desired cleaning has been achieved, there being no reason to remove the lance 11 from the high temperature environment because of limitations on the equipment. For example, 17 may continue substantially uninterrupted for 15 minutes, 30 minutes, or more, e.g. 45–180 minutes. Also because lance 11 may easily have an operative length of 40 feet, or even more, 17 may be practiced without the need to reposition constantly in order to reach surfaces to be cleaned.

While the method schematically illustrated in FIG. 1 can be practiced for almost any surfaces in high temperature environments that need cleaning, the method is ideally suited for cleaning surfaces in furnaces, or for high temperature installations in the petrochemical industry, such as reheat tubes, or any metal surfaces where scale buildup impedes thermal transfer efficiency. The method of the invention is particularly suitable for what is commonly known as "white metal cleaning" in the petrochemical industry, where the metal is cleaned so that it is free of scale or other buildup.

FIG. 2 schematically illustrates one version of a conventional ceramic welding lance 11 that is utilized as the blasting media introduction lance according to the invention. The stainless steel lance 11 has an outer jacket 18 into which cooling liquid is introduced as indicated schematically at 19, water being the typical cooling liquid. The lance 11 also has an inner jacket 20 that returns the cooling liquid after it has effectively cooled the lance 11 through the cooling liquid source as illustrated schematically at 21 in FIG. 2. Substantially concentric with the stainless steel jackets 18, 20 is an internal stainless steel tube 22 into which particulate blasting media, indicated schematically at 23 in FIG. 2, is introduced at superatmospheric pressure. The blasting media from 23 passes through the internal tube 22 until it issues out of nozzle or any other suitable media-defining opening 24 at the end of the lance 11 remote from the sources 19, 21, 23. The source 23 for the blasting media typically comprises a conventional pump used in ceramic welding operations, such as those of Fosbel, Inc., and other companies in the Fosbel Group, and the water is circulated through the steel jackets 18, 20 utilizing conventional circulating pumps, again of the type used in conventional ceramic welding operations.

While one exemplary lance 11 configuration is illustrated in FIG. 2, it is to be understood that any suitable lance such as of the types for ceramic welding may be utilized, including double shell, or any other type. The only limitation is that the lance 11 needs to be capable of long term operation in a high temperature facility without damage, and delivering the particulate blasting media 14 from source 23 in an effective manner without clogging or degradation of the media.

While the pressure at which the blasting media 14 is introduced from source 23 and from the nozzle 24 into contact with the surface 12 may vary depending upon the particular nature of the surface 12 and the particular blasting media 14 utilized, when using preferred blasting media according to the invention the pressure is typically between about 40–100 psi, e.g. about 60–80 psi. Preferably the blasting media 14 that is utilized is a media that combusts at a temperature of the environment surrounding the surfaces 12 to be cleaned, so that after impacting the surfaces 12 the blasting media 14 will not build up significantly in the environment, but rather will only leave a small residue, or none at all. For example, the blasting media 14 may have a hardness of between about 2–4 moh, and an average particle size between about 10–100 mesh, again depending upon the material to be utilized as the blasting media 14 and the surfaces 12 to be cleaned. For example, a mesh size of about 30–60 would be desirable for most installations. Also, in many circumstances it is desirable to have a blasting media with a modulus of elasticity greater than 75,000 psi.

The blasting media 14 may be one or more organic agricultural abrasive materials as at least the primary, or perhaps substantially the sole, constituent. Typical organic media that may be utilized includes pecan, coconut, almond, or acorn shells, corn cobs, peach, cherry, apricot, or plum pits, or even some organic seeds such as olive and prune seeds. However, the preferred blasting media 14 is walnut shell, and particularly black walnut shells.

While organic agricultural abrasive materials, particularly black walnut shells, are the preferred blasting media according to the invention, for some surfaces and under some circumstances it may be desirable to use other blasting media as the sole blasting media, or mixed with the organic agricultural abrasive materials. For example, PMB media can be utilized solely or mixed with walnut shells or the like, the different types of PMB having a hardness ranging from 3.0–4.0 moh, and typically the particle thereof in the size range of from 12 to 40 mesh.

In the above description it is to be understood that all broad ranges include all narrower ranges within the broad range. For example, the pressure range of 40–100 psi includes every other conceivable narrower range within that broad range (e.g. 50–60 psi, 45–85 psi, etc.).

It will thus be seen that according to the present invention a highly advantageous method is provided for cleaning high temperature surfaces at high temperature, and in situ, including for practicing white metal cleaning, cleaning furnace surfaces even during furnace operation, cleaning reheat tubes, and cleaning heat exchanger surfaces having scale buildup.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and procedures.

What is claimed is:

1. A method of cleaning surfaces at high temperature using a liquid-cooled lance, comprising:

(a) while the surfaces are at a temperature of 400 degrees F or more, positioning the liquid-cooled lance in operative association with the surfaces;

(b) introducing particulate blasting media through the lance under super-atmospheric pressure so that the blasting media impacts the surfaces and cleans them while the surfaces are at a temperature of 400 degrees F or more; and (c) continuing (b), without the necessity of removing the lance to a location remote from operative positioning with respect to the surfaces, until the surfaces are substantially cleaned.

2. A method as recited in claim 1 wherein (a)–(c) are practiced while the surfaces are at a temperature of more than 1000 degrees F.

3. A method as recited in claim 1 wherein (a)–(c) are practiced to clean metal surfaces having scale buildup which adversely affects the ability of the metal surfaces to transfer heat.

4. A method as recited in claim 1 wherein (a)–(c) are practiced to clean reheat tubes or process tubes.

5. A method as recited in claim 1 wherein (b) is practiced using a blasting media that combusts at the temperature of the environment surrounding the surfaces to be cleaned, so that after impacting the surfaces the blasting media will not build up significantly in the environment, and will not be environmentally damaging.

6. A method as recited in claim 5 wherein (b) is practiced using one or more organic agricultural abrasive materials as the primary or substantially sole constituent of the blasting media.

7. A method as recited in claim 6 wherein (b) is practiced by using black walnut shells as substantially the sole constituent of the blasting media.

8. A method as recited in claim 5 wherein (b) is practiced by using a blasting media having an average hardness of between about 2–4 moh, a modulus of elasticity of greater than 75,000 psi, and an average particle size of between about 10–100 mesh.

9. A method as recited in claim 1 wherein (c) is practiced substantially continuously for more than 30 minutes, and while a unit containing the surfaces is operating.

10. A method as recited in claim 8 wherein (a)–(c) are practiced to clean furnace surfaces while at operating furnace temperatures.

11. A method as recited in claim 1 wherein (a)–(c) are practiced to clean, while in operation or in situ, metal surfaces having scale buildup which adversely affects the ability of the metal surfaces to transfer heat, reheat tubes, process tubes, or furnace surfaces.

12. A method as recited in claim 11 wherein (b) is practiced using black walnut shells as the primary or substantially sole constituent of the blasting media.

13. A method as recited in claim 12 wherein (b) is practiced by directing the black walnut shells at the surfaces at a pressure of between about 40–100 psi.

14. A method as recited in claim 11 wherein (c) is practiced substantially continuously for more than 30 minutes, and while a unit containing the surfaces is operating.

15. A method of cleaning surfaces at high temperature using a liquid-cooled lance, comprising:

(a) while the surfaces are at a temperature of 400 degrees F or more, positioning the liquid-cooled lance in operative association with the surfaces; and (b) introducing particulate blasting media through the lance under super-atmospheric pressure so that the blasting media impacts the surfaces and cleans the surfaces while the surfaces are at a temperature of 400 degrees F or more; and wherein (b) is practiced using a blasting media that combusts at the temperature of the environment surrounding the surfaces to be cleaned, so that after impacting the surfaces the blasting media will not build up significantly in the environment.

16. A method as recited in claim 15 wherein (b) is practiced using one or more organic agricultural abrasive materials as the primary constituent of the blasting media, and by directing the media at the surfaces at a pressure of between about 40–100 psi.

17. A method as recited in claim 15 wherein (b) is practiced by using black walnut shells as substantially the sole constituent of the blasting media.

18. A method as recited in claim 15 wherein (b) is practiced by using a blasting media having an average hardness of between about 2.5–4 moh, and having an average particle size of between about 10–100 mesh.

19. A method as recited in claim 15 wherein (a) and (b) are practiced substantially continuously for at least 30 minutes.

20. A method of cleaning a surface at a temperature of 1000° F. or more by directing substantially continuously for at least 15 minutes a substantially combustible, particulate blasting media comprising primarily, or substantially solely, black walnut shells, under super-atmospheric pressure against the surface to be cleaned so that the blasting media impacts the surface and effects abrasive cleaning thereof, and then combusts.

* * * * *

UNITED STATES PATENT AND TRADEMARK OFFICE
Certificate

Patent No. 6,186,869 B1 Patented: February 13, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Steve Cherico, North Olmstead, OH; Dale R. Miller, II, Middleburg Heights, OH; and James C. Knight, Sharpsville, PA.

Signed and Sealed this Thirteenth Day of January 2004.

ALLEN M. OSTRAGER
*Supervisory Patent Examiner*
*Art Unit 3725*